US006506225B1

(12) United States Patent
Pirker

(10) Patent No.: US 6,506,225 B1
(45) Date of Patent: Jan. 14, 2003

(54) METHOD FOR INTEGRATED DESULFURIZING OF PIG IRON MELT AND STEEL MELT

(75) Inventor: Hermann Pirker, Steyregg (AT)

(73) Assignee: Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/700,432

(22) PCT Filed: Mar. 18, 1999

(86) PCT No.: PCT/AT99/00069

§ 371 (c)(1),
(2), (4) Date: Nov. 28, 2000

(87) PCT Pub. No.: WO99/60173

PCT Pub. Date: Nov. 25, 1999

(30) Foreign Application Priority Data

May 20, 1998 (AT) ..... 875/98

(51) Int. Cl.[7] ..... C21C 7/076
(52) U.S. Cl. ..... 75/10.35
(58) Field of Search ..... 75/10.36

(56) References Cited

U.S. PATENT DOCUMENTS 5,397,379 A * 3/1995 Barker et al. ..... 75/303
5,466,275 A * 11/1995 More ..... 75/10.46
6,179,895 B1 * 1/2001 Barker ..... 75/303

FOREIGN PATENT DOCUMENTS

DE 3836549 1/1990
DE 19546738 6/1997
EP 0627012 12/1994
WO 9317131 9/1993

* cited by examiner

*Primary Examiner*—Roy King
*Assistant Examiner*—Tima McGuthry-Banks
(74) *Attorney, Agent, or Firm*—Ostrolenk, Faber, Gerb & Soffen, LLP

(57) ABSTRACT

In a steelmaking process in which, in order to desulfurize iron melts (4) using a strongly basic slag in a desulfurization vessel (7), the desulfurization slag (8) is brought to a temperature of from 1400–1800° C. by heating, and this desulfurization slag (8) is used to desulfurize the sulfur-containing iron melt, which is then poured off without any slag either discontinuously or continuously beneath the desulfurization slag (8), the ratio of iron melt (4) to desulfurization slag (8) not exceeding the value of 10:1 parts by weight, and the desulfurization slag (8) being regenerated continuously and/or discontinuously, and then a steel melt (21) being produced from the iron melt (4), to simplify a subsequent ladle treatment of the crude steel (11) produced from the desulfurized pig iron (4), in particular to minimize energy consumption and to avoid material which has to be landfilled, a partial amount of the desulfurization slag (8) from the desulfurization vessel (7) is introduced into a steel-casting ladle (19) for the desulfurized iron melt (4) which has been converted to form a crude steel melt (11), and this partial amount is recirculated after the ladle treatment and after the steel melt (21) formed in this way has been poured off (FIG.).

10 Claims, 1 Drawing Sheet

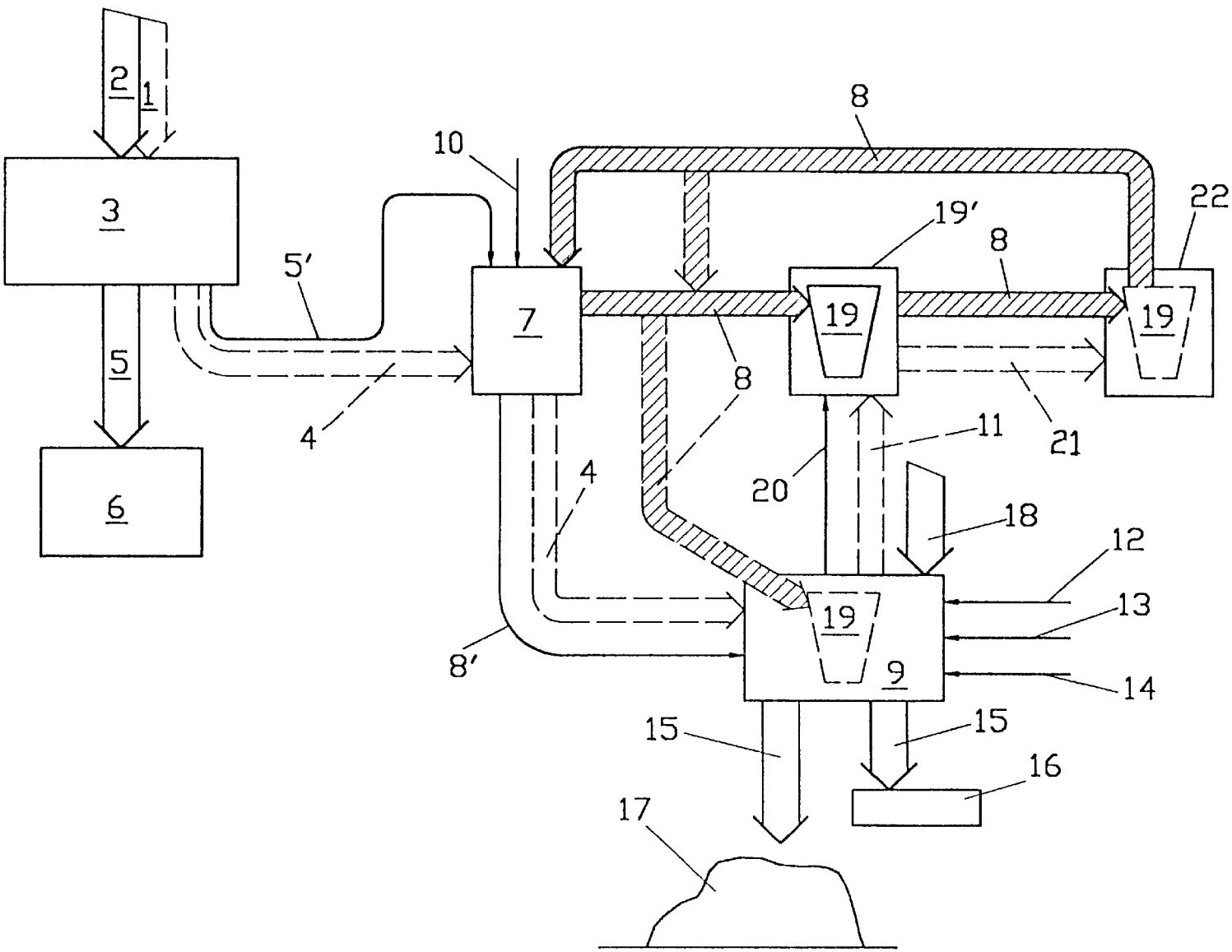
22
19
8
19'
8
19
21
11
20
8
12
13
14
18
9
19
15
16
15
17
4
7
10
8'
5'
4
1
2
3
5
6

METHOD FOR INTEGRATED DESULFURIZING OF PIG IRON MELT AND STEEL MELT

The invention relates to a process for producing steel melts, in which, to desulfurize iron melts, a desulfurization slag of the following chemical analysis $SiO_2$ max. 20 % by weight $Al_2O_3$ max. 50% by weight $SiO_2+Al_2O_3+TiO_2$=5–40% by weight FeO max. 2.0% by weight MnO max. 1.5% by weight $CaO+MgO+BaO+Na_2O+K_2O$=25–65% by weight MgO max. 20% by weight $Na_2O+K_2O$ max. 10% by weight $CaF_2$=0–60% by weight $CaO+MgO+BaO+Na_2O+K_2O+CaF_2$=50–85% by weight $$\frac{CaO + MgO}{SiO_2 + 0.5Al_2O_3} \text{min. } 2$$

$$\frac{Na_2O + K_2O}{SiO_2} \text{max. } 1$$

and impurities from the raw materials is brought to a temperature of from 1400–1800° C. in a desulfurization vessel through heating of the desulfurization slag, preferably by means of electrodes which are immersed in the desulfurization slag, and this desulfurization slag is used to desulfurize the sulfur-containing iron melt, which is then poured off, as far as possible without any slag, either discontinuously or continuously below the desulfurization slag, the ratio of iron melt to desulfurization slag not exceeding the value of 10:1 parts by weight, and the desulfurization slag being regenerated continuously and/or discontinuously for a further pig-iron desulfurization treatment, and then a steel melt being produced from the iron melt.

A process of this type is known from EP-0 627 012 B1. This known process has particular advantages over other known desulfurization processes, including, inter alia, the avoidance of the amounts of slag produced which previously had to be landfilled or reprocessed in a complex way, the avoidance of expensive desulfurizing agents, such as lime, carbide, magnesium, etc., the avoidance of iron losses which occur during the deslagging involved in pig-iron desulfurization, and the avoidance of a temperature drop in the pig iron during the desulfurization. The pig iron which has been desulfurized down to very low S contents using the process which is known from EP-0 627 012 B1 is used as a starting material for steelmaking and, for this purpose, is used, for example, in a converter or an electric furnace.

The object of the invention is to develop this process further in such a way that, during a ladle treatment of the crude steel produced from the desulfurized pig iron, no additional slag components are required, so that associated problems of introducing additives and disposing of the ladle slag are eliminated. It is to be possible to carry out the ladle treatment with a very small supply of energy, and steel losses such as those which usually occur during casting after the ladle treatment (residual steel in the steel-casting ladle), are to be minimized or avoided.

According to the invention, this object is achieved by the fact that for a subsequent ladle treatment of a crude steel melt, a partial amount of the desulfurization slag from the desulfurization vessel is introduced into a steel-casting ladle which is to receive the desulfurized iron melt, which has been converted into a crude steel melt, and this partial amount is recirculated after the ladle treatment and after the steel melt formed in this way has been poured off. The slag from the desulfurization vessel, which is used to desulfurize the pig iron, which is fed to the steel-casting ladle therefore entirely replaces the components of the synthetic slag which, according to the prior art, have to be supplied to a ladle furnace. Since this slag is fully recirculated, i.e. is reintroduced into the desulfurization vessel, there is no landfill material produced in connection with the ladle metallurgy; the desulfurization slag is passed through a closed circuit.

Entrained slag from the converter or electric furnace and deoxidation products are incorporated in the circuit, since they are combined with the desulfurization slag during or after tapping. This additional amount causes the amount of slag in the pig-iron desulfurization to rise gradually, and the excess quantity may advantageously be utilized together with the slag which is formed during the steel making.

Advantageously, after the steel melt has been poured off, a residual amount of the steel melt which remains in the steel-casting ladle is recirculated together with the desulfurization slag which is to be recirculated, and is introduced into the iron melt which has not yet been desulfurized in the desulfurization vessel, with the result that for quality reasons the amount of residual steel can be kept at a greater level compared to the prior art. Entrainment of slag during casting of the steel can be prevented more reliably or ruled out altogether. This is particularly advantageous if continuous casting is used, since in this way it is very easy to prevent slag from penetrating into a tundish of a continuous-casting installation.

It is known from DE-195 46 738 C2 to carry out a desulfurization treatment with the aid of a desulfurization agent which is in powder form, in which case, during a ladle metallurgy treatment carried out on a steel melt, the slag which is produced in the ladle furnace, after the steel melt has been cast, is introduced, together with a residual amount of steel, into a hot pig-iron charging ladle, and further pig-iron melt which is to be desulfurized is added to this ladle. Then, the pulverulent desulfurizing agent is added, the melt together with the desulfurizing agent being made turbulent with the aid of a carrier gas. However, in this known process it is necessary to use the usual ladle slag components for the ladle metallurgy, which represents a considerable financial outlay both for the production of the ladle slag and its disposal.

According to the invention, the partial amount of the desulfurization slag which is removed from the desulfurization vessel and introduced into the steel-casting ladle is expediently less than 30 kg/t of iron melt, preferably less than 20 kg/t of iron melt.

According to a preferred embodiment, a partial amount of the desulfurization slag is removed from the desulfurization vessel and introduced into the steel-casting ladle after the regeneration. This is particularly advantageous if very low sulfur contents are important, since the slag from the pig-iron treatment vessel has a high slag-uptake capacity.

Another preferred embodiment is characterized in that a partial amount of the desulfurization slag is removed from the desulfurization vessel and introduced into the steel-casting ladle before the regeneration. In this case too, it is possible to considerably reduce the sulfur contents in the steel, but the partial amount of the desulfurization slag can be removed from the desulfurization vessel immediately after the pig-iron desulfurization which takes place in this vessel. On account of the large volume of slag for the pig-iron treatment, the sulfur level is still relatively low, or the slag is able to take up sulfur from the steel, even before the regeneration of the slag.

It is advantageous if the partial amount of the desulfurization slag which is removed from the desulfurization vessel is transferred to the steel-casting ladle with thermal insulation and in the liquid state, in which case, advantageously, the desulfurization slag which has been removed from the steel-casting ladle and is to be recirculated into the desulfurization vessel is also conveyed, i.e. recirculated, to the desulfurization vessel with thermal insulation and in the liquid state.

The desulfurization slag is expediently transferred by means of transfer vessels which have been suitably preheated and insulated. To reduce the outlay on this transfer, it is expedient for slag (if appropriate together with residual steel) from a plurality of steel batches to be transferred back and forth together in a single transfer vessel, if appropriate in combination with a ladle-heating burner.

The partial amount of slag may be poured into the steel-casting ladle before or after the crude steel is added to the steel-casting ladle, adding the steel later having the advantage of bringing about thorough turbulence and therefore possibly an additional desulfurization reaction, specifically even when the slag already has a relatively high sulfur content. Moreover, this promotes the separation of nonmetallic inclusions which are produced by deoxidation and therefore improves the purity of the steel.

The invention is explained in more detail below with reference to an exemplary embodiment which is illustrated in the form of a flow diagram in the drawing. Pig iron 4 is smelted from iron ore 1 together with gangue of ore, lime, ash, coke, coal, etc. in a pig-iron smelting plant 3, such as in a blast furnace or a smelting reduction plant, such as for example a COREX plant. Slag 5 originating from the blast-furnace process or the direct reduction process is fed to a slag utilization system 6. Part of this slag 5 passes with the pig iron 4, as entrained slag 5', to a pig-iron desulfurization plant or—if there is a large quantity of this slag—is generally slagged off from a transfer ladle before the pig-iron desulfurization.

The pig iron 4 is introduced into a desulfurization vessel 7, which is designed, for example, as a low-shaft furnace, which can be electrically heated by means of electrodes made from graphite or coal, or as a heatable ladle, and is subjected to a desulfurization process in this vessel by means of a special desulfurization slag 8. As an alternative to the low-shaft furnace, it is also possible to use a suitably adapted electric furnace. A tapping hole allows the pig iron to be discharged without any slag. In this desulfurization vessel 7, on a one-off basis, resistance heating is used to melt a sufficient amount of basic desulfurization slag 8 of a chemical composition as listed in the table below for an iron melt: desulfurization slag weight ratio of <10, preferably <5, and, in the case of continuous desulfurization, preferably <2.5 to be maintained during the desulfurization process. This desulfurization slag 8 is constantly reused, for which purpose it is continuously regenerated, so that the overall specific consumption of this synthetic slag is negligible.

Table $SiO_2$ max. 20 % by weight $A_2O_3$ max. 50% by weight $SiO_2+Al_2O_3+TiO_2$=5–40% by weight FeO max. 2.0% by weight MnO max. 1.5% by weight $CaO+MgO+BaO+Na_2O+K_2O$=25–65% by weight MgO max. 20% by weight $Na_2O+K_2O$ max. 10% by weight $CaF_2$=0–60% by weight $CaO+MgO+BaO+Na_2O+K_2O+CaF_2$=50–85% by weight $$\frac{CaO + MgO}{SiO_2 + 0.5Al_2O_3} \text{min. } 2$$

$$\frac{Na_2O + K_2O}{SiO_2} \text{max. } 1$$

The desulfurization process which takes place in a desulfurization vessel 7 of this type is described in detail in EP 0 627 012 B1. The details of the desulfurization process described in that document can also be applied to the present process according to the invention.

After the desulfurization of the pig iron 4 has been carried out, this iron is tapped, as described in EP 0 627 012 B1, into a pig-iron charging ladle and is subjected to a steelmaking process 9, for example in a converter or an electric furnace. Part of the desulfurization slag 8 can also be fed to the converter or electric furnace together with the pig iron 4, as so-called excess slag 8' This excess slag 8' is formed by entrained slag which has not been slagged off from the blast furnace, etc. and when slag is combined using a ladle furnace for the entrained slag which is produced during the steel deoxidation in the converter or electric furnace, as is to be explained in more detail below.

To maintain a constant chemical composition of the desulfurization slag 8' despite the entrained slags and/or deoxidation products, added amounts 10 of the order of magnitude between 5 and 10 kg/t of steel are introduced into the desulfurization vessel 7. In particular the relatively high $SiO_2$ content of the blast-furnace slag requires more added amounts in order to maintain the ideal composition of the pig-iron desulfurization slag. The P content of the in relative terms smaller amount of entrained slag from converter and electric furnace is negligible.

During the production of crude steel 11 from the pig iron 4, alloys 12, cool scrap 13 and/or scrap 14 are added, and the slag 15 formed in the process is either fed for slag utilization, in particular converter slag utilization, or is landfilled 17 or processed in some other way. Furthermore, other additions 18 as are usually required for crude steel production also pass into the converter or electric furnace.

The crude steel 11 produced in this way is tapped into a steel-casting ladle 19 together with a small amount of entrained slag 20 (up to 5 kg/t of steel). A partial amount of the desulfurization slag 8, specifically up to at most 30 kg/t of steel, preferably up to 20 kg/t of steel, is also introduced into this steel-casting ladle 19. The desulfurization slag 8 is added to the steel-casting ladle 19 before or after the tapping of the steel. The steel-casting ladle 19 containing crude steel 11 and slag 20 and 8 is usually introduced into a ladle furnace 19' which can be heated electrically, preferably by means of electrodes. There then follows a standard ladle treatment of the crude steel 11, during which the crude steel 11 is preferably thoroughly mixed with the transferred partial amount of the desulfurization slag 8, for example by the desulfurization slag 8 being added to the steel-casting ladle 19 when it is still empty and the crude steel 11 only subsequently being tapped, onto the desulfurization slag. The ladle treatment and the casting of the finished steel 21, for example in a continuous-casting installation 22, then take place. The desulfurization slag 8 which remains in the steel-casting ladle 19 after the steel 21 has been cast is in turn fed back to the desulfurization vessel 7, i.e. is fully recirculated.

The treatment of the crude steel 11 in the steel-casting ladle 19 may also take place without heating, for example if a degassing treatment and/or an improvement in the level of purity is all that is intended.

The movement of the steel-casting ladle 19 from the steelmaking at 9 to the ladle furnace 19' and to the continuous-casting installation 22 and back is illustrated by the steel-casting ladle 19 shown in dashed lines.

The partial amount of the desulfurization slag 8 which has been removed from the desulfurization vessel 7 and fed to the steel-casting ladle 19 is removed either before or after its regeneration, which, as described in EP-0 627 012 B1, is carried out by the addition of manganese ore, air, oxygen, etc. In both cases, it is possible to ensure a particularly low sulfur content in the finished steel 21, and ultimately, when desulfurization slag 8 which has already been regenerated is removed and thoroughly mixed with the crude steel 11, it is possible to set a particularly low sulfur content of, for example, <6 ppm. This can be achieved through the very low sulfur content of the pig iron which is generally set using the pig-iron desulfurization process and therefore the already very low sulfur content in the steel when it is tapped, and the very considerable capacity of the slag to take up sulfur from the desulfurization vessel 7 with a sulfur distribution Ls >500 (in the equilibrium state)

$$\text{Sulfur distribution } Ls = \frac{\text{Sulfur content in the slag}}{\text{Sulfur content in the steel}}$$

In particular, suitably preheated and insulated transfer vessels, advantageously line conveyors with a tilting device, are to be used to transfer the partial amount of the desulfurization slag 8 from the desulfurization vessel 7 to the steel-casting ladle 19 and back to the desulfurization vessel 7.

The advantages of the process according to the invention are as follows:

During the ladle furnace treatment of the crude steel 11, the ladle furnace 19' has to be electrically heated to only a slight extent and since there is no need to melt in any solid slag components (the partial amount of desulfurization slag 8 which is introduced in a liquid form and as hot as possible), noise emissions are also considerably reduced. In addition, the fact that, compared to the prior art, a significantly larger amount of slag in the liquid state can be cost-effectively employed in the steel-casting ladle 19 also plays a role in this context.

Since only slight heating is required in the ladle furnace 19', the result is only a low level of arc radiation, and even this arc radiation is absorbed by the relatively large amount of slag which is used according to the invention. Consequently, the arc is successfully sheathed.

Furthermore, there is also more time available for purging, i.e. for "purity purging", so that it is possible to ensure a particularly pure steel. The considerably increased amount of slag in the steel-casting ladle 19 also results in a significantly lower nitrogen uptake, specifically because there is scarcely any direct contact between the arc and air. A lower hydrogen uptake is ensured by the fact that there is no need to melt any lime in the steel-casting ladle 19.

The fact that a relatively large amount of residual steel (from steel 21) can remain in the steel-casting ladle 19—since this residual steel is recirculated without any losses together with the desulfurization slag 8, specifically by being added to the pig iron 4 in the desulfurization vessel 7—leads to quality advantages which come to bear in particular during continuous casting: it is reliably possible to avoid slag being entrained into a tundish of a continuous-casting plant.

A further advantage of the process according to the invention is that the bottom of the steel-casting ladle 19 is very clean after the desulfurization slag 8 has been emptied. There is no skull formation or caked-on slag. On account of the very large amount of desulfurization slag 8, a sufficiently high temperature is ensured even while the desulfurization slag 8, if appropriate together with a residual amount of steel, is being transferred back, so that both the desulfurization slag 8 and the residual amount of steel can be recirculated in liquid form.

The extended buffer function of the ladle furnace 19' is also of importance; the fact that there is no need for a prolonged heating period means that the net treatment time at the ladle furnace 19' is significantly shorter and there is more time available for buffering between converter/electric furnace and continuous-casting plant, inter alia for sequence casting.

What is claimed is:

1. A process for desulfurizing sulfur containing iron melt and converting the desulfurized iron melt to a steel melt, comprising:

(a) bringing a desulfurization slag of the following chemical analysis:

$SiO_2$ max. 20% by weight $Al_2O_3$ max. 50% by weight $SiO_2+Al_2O_3+TiO_2$=5–40% by weight FeO max. 2.0% by weight MnO max. 1.5% by weight $CaO+MgO+BaO+Na_2O+K_2O$=25–65% by weight MgO max. 20% by weight $Na_2O+K_2O$ max. 10% by weight $CaF_2$=0–60% by weight $CaO+MgO+BaO+Na_2O+K_2O+CaF_2$=50–85% by weight $$\frac{CaO + MgO}{SiO_2 + 0.5Al_2O_3} \text{min. } 2$$

$$\frac{Na_2O + K_2O}{SiO_2} \text{max. } 1$$

to a temperature of 1400°–1800° C., (b) introducing the slag at said temperature along with a sulfur containing iron melt into a desulfurization vessel, the ratio of iron melt to desulfurization slag not exceeding 10:1 parts by weight, (c) separating the desulfurized iron melt from the desulfurization slag, (d) introducing said desulfurized iron melt into a steel making apparatus for producing a steel melt, (e) introducing the produced steel melt into a steel casting ladle together with a partial amount of the desulfurization slag from the desulfurization vessel, (f) discharging the steel melt from the steel casting ladle, and (g) introducing the slag of the steel casting ladle into said desulfurization vessel after the steel melt has been discharged.

2. A process for desulfurizing sulfur containing iron melt and converting the desulfurized iron melt to a steel melt, comprising:

(a) bringing a desulfurization slag of the following chemical analysis:

$SiG_{2\ max.}$ 20% by weight $Al_2O_3$ max. 50% by weight $SiO_2+Al_2O_3TiO_2$=5–40% by weight FeO max. 2.0% by weight
MnO max. 1.5% by weight
$CaO+MgO+BaO+Na_2O+K_2O$=25–65% by weight
MgO max. 20% by weight
$Na_2O+K_2O$ max. 10% by weight
$CaF_2$=0–60% by weight
$CaO+MgO+BaO+Na_2O+K_2O+CaF_2$=50–85% by weight $$\frac{CaO+MgO}{SiO_2+0.5Al_2O_3}\text{min. } 2$$

$$\frac{Na_2O+K_2O}{SiO_2}\text{max. } 1$$

to a temperature of 1400°–1800° C., (b) introducing the slag at said temperature along with a sulfur containing iron melt into a desulfurization vessel, the ratio of iron melt to desulfurization slag not exceeding 10:1 parts by weight, (c) separating the desulfurized iron melt from the desulfurization slag, (d) introducing said desulfurized iron melt together with part of the desulfurization slag into a steel casting ladle, (e) separately withdrawing the resulting steel melt and the desulfurizing slag, and (f) regenerating and recirculating the desulfurized slag, said process being further characterized in that, after the steel melt has been poured off, a residual amount of the steel melt which remains in the steel-casting ladle is recirculated together with the desulfurization slag which is to be recirculated, and is introduced into the iron melt prior to its desulfurization.

3. A process for desulfurizing sulfur containing iron melt and converting the desulfurized iron melt to a steel melt, comprising:

(a) bringing a desulfurization slag of the following chemical analysis:
$SiO_2$ max. 20% by weight
$Al_2O_3$ max. 50% by weight
$SiO_2+Al_2O_3+TiO_2$=5–40% by weight
FeO max. 2.0% by weight
MnO max. 1.5% by weight
$CaO+MgO+BaO+Na_2O+K_2O$=25–65% by weight
MgO max. 20% by weight
$Na_2O+K_2O$ max. 10% by weight
$CaF_2$=0–60% by weight
$CaO+MgO+BaO+Na_2O+K_2O+CaF_2$=50–85% by weight $$\frac{CaO+MgO}{SiO_2+0.5Al_2O_3}\text{min. } 2$$

$$\frac{Na_2O+K_2O}{SiO_2}\text{max. } 1$$

to a temperature of 1400°–1800° C., (b) introducing the slag at said temperature along with a sulfur containing iron melt into a desulfurization vessel, the ratio of iron melt to desulfurization slag not exceeding 10:1 parts by weight, (c) separating the desulfurized iron melt from the desulfurization slag, (d) introducing said desulfurized iron melt together with part of the desulfurization slag into a steel casting ladle, (e) separately withdrawing the resulting steel melt and the desulfurizing slag, and (f) regenerating and recirculating the desulfurized slag, said process being further characterized in that the partial amount of the desulfurization slag which is removed from the desulfurization vessel and introduced into the steel-casting ladle is less than 30 kg/t of iron melt.

4. The process as claimed in claim 1, characterized in that a partial amount of the desulfurization slag is removed from the desulfurization vessel and introduced into the steel-casting ladle after regeneration.

5. A process for desulfurizing sulfur containing iron melt and converting the desulfurized iron melt to a steel melt, comprising:

(a) bringing a desulfurization slag of the following chemical analysis:
$SiO_2$ max. 20% by weight
$Al_2O_3$ max. 50% by weight
$SiO_2+Al_2O_3+TiO_2$=5–40% by weight
FeO max. 2.0% by weight
MnO max. 1.5% by weight
$CaO+MgO+BaO+Na_2O+K_2O$=25–65% by weight
MgO max. 20% by weight
$Na_2O+K_2O$ max. 10% by weight
$CaF_2$=0–60% by weight
$CaO+MgO+BaO+Na_2O+K_2O+CaF_2$=50–85% by $$\frac{CaO+MgO}{SiO_2+0.5Al_2O_3}\text{min. } 2$$

$$\frac{Na_2O+K_2O}{SiO_2}\text{max. } 1$$

to a temperature of 14000°–1800° C., (b) introducing the slag at said temperature along with a sulfur containing iron melt into a desulfurization vessel, the ratio of iron melt to desulfurization slag not exceeding 10:1 parts by weight, (c) separating the desulfurized iron melt from the desulfurization slag, (d) introducing said desulfurized iron melt together with part of the desulfurization slag into a steel casting ladle, (e) separately withdrawing the resulting steel melt and the desulfurizing slag, and (f) regenerating and recirculating the desulfurized slag, said process being further characterized in that a partial amount of the desulfurization slag is removed from the desulfurization vessel and introduced into the steel-casting ladle before regeneration.

6. A process for desulfurizing sulfur containing iron melt and converting the desulfurized iron melt to a steel melt, comprising:

(a) bringing a desulfurization slag of the following chemical analysis:
$SiO_2$ max. 20% by weight
$Al_2O_3$ max. 50% by weight
$SiO_2+Al_2O_3+TiO_2$=5–40% by weight
FeO max. 2.0% by weight
MnO max. 1.5% by weight
$CaO+MgO+BaO+Na_2O+K_2O$=25–65% by weight
MgO max. 20% by weight
$Na_2O+K_2O$ max. 10% by weight
$CaF_2$=0–60% by weight
$CaO+MgO+BaO+Na_2O+K_2O+CaF_2$=50–85% by weight $$\frac{CaO + MgO}{SiO_2 + 0.5Al_2O_3} \text{min. } 2$$

$$\frac{Na_2O + K_2O}{SiO_2} \text{max. } 1$$

to a temperature of 1400°–1800° C., (b) introducing the slag at said temperature along with a sulfur containing iron melt into a desulfurization vessel, the ratio of iron melt to desulfurization slag not exceeding 10:1 parts by weight, (c) separating the desulfurized iron melt from the desulfurization slag, (d) introducing said desulfurized iron melt together with part of the desulfurization slag into a steel casting ladle, (e) separately withdrawing the resulting steel melt and the desulfurizing slag, and (f) regenerating and recirculating the desulfurized slag, said process being further characterized in that the partial amount of the desulfurization slag which is removed from the desulfurization vessel is transferred to the steel-casting ladle with thermal insulation and in the liquid state.

7. A process for desulfurizing sulfur containing iron melt and converting the desulfurized iron melt to a steel melt, comprising:

(a) bringing a desulfurization slag of the following chemical analysis:

$SiO_2$ max. 20% by weight
$Al_2O_3$ max. 50% by weight
$SiO_2+Al_2O_3+TiO_2$=5–40% by weight
FeO max. 2.0% by weight
MnO max. 1.5% by weight
$CaO+MgO+BaO+NaO+K_2O$=25–65% by weight
MgO max. 20% by weight
$Na_2O+K_2O$ max. 10% by weight
$CaF_2$=0–60% by weight
$CaO+MgO+BaO+Na_2O+K_2O+CaF_2$=50–85% by weight $$\frac{CaO + MgO}{SiO_2 + 0.5Al_2O_3} \text{min. } 2$$

$$\frac{Na_2O + K_2O}{SiO_2} \text{max. } 1$$

to a temperature of 1400°–1800° C., (b) introducing the slag at said temperature along with a sulfur containing iron melt into a desulfurization vessel, the ratio of iron melt to desulfurization slag not exceeding 10:1 parts by weight, (c) separating the desulfurized iron melt from the desulfurization slag, (d) introducing said desulfurized iron melt together with part of the desulfurization slag into a steel casting ladle, (e) separately withdrawing the resulting steel melt and the desulfurizing slag, and (f) regenerating and recirculating the desulfurized slag, said process being further characterized in that the desulfurization slag which has been removed from the steel-casting ladle is recirculated, to the desulfurization vessel with thermal insulation and in the liquid state and introducing the remaining slag of the steel casting ladle into the desulfurization vessel after the steel melt has been withdrawn.

8. A process for desulfurizing sulfur containing iron melt and converting the desulfurized iron melt to a steel melt, comprising:

(a) bringing a desulfurization slag of the following chemical analysis:

$SiO_2$ max. 20% by weight
$Al_2O_3$ max. 50% by weight
$SiO_2+Al_2O_3+TiO_2$=5–40% by weight
FeO max. 2.0% by weight
MnO max. 1.5% by weight
$CaO+MgO+BaO+Na_2O+K_2O$=25–65% by weight
MgO max. 20% by weight
$Na_2O+K_2O$ max. 10% by weight
$CaF_2$=0–60% by weight
$CaO+MgO+BaO+Na_2O+K_2O+CaF_2$=50–85% by weight $$\frac{CaO + MgO}{SiO_2 + 0.5Al_2O_3} \text{min. } 2$$

$$\frac{Na_2O + K_2O}{SiO_2} \text{max. } 1$$

to a temperature of 1400°–1800° C., (b) introducing the slag at said temperature along with a sulfur containing iron melt into a desulfurization vessel, the ratio of iron melt to desulfurization slag not exceeding 10:1 parts by weight, (c) separating the desulfurized iron melt from the desulfurization slag, (d) introducing said desulfurized iron melt together with part of the desulfurization slag into a steel casting ladle, (e) separately withdrawing the resulting steel melt and the desulfurizing slag, and (f) regenerating and recirculating the desulfurized slag, said process being further characterized in that the partial amount of the desulfurization slag removed from the desulfurization vessel is introduced into the steel-casting ladle before crude steel melt is added to the steel-casting ladle.

9. The process as claimed in claim 1, characterized in that the partial amount of the desulfurization slag which has been removed from the desulfurization vessel is poured into the steel-casting ladle after crude steel melt has been poured into the steel-casting ladle.

10. The process as claimed in claim 3, wherein the partial amount of desulfurization slag which is removed from the desulfurization vessel and introduced into the steel-casting ladle is less than 20 kg/t of iron melt.

* * * * *